United States Patent [19]

Burrows et al.

[11] Patent Number: 4,877,244

[45] Date of Patent: Oct. 31, 1989

[54] BASEBALL GAME APPARATUS

[76] Inventors: Garry L. Burrows, 924 Rodman Way; Michael R. Burrows, 937 Rodman Way, both of, Baltimore, Md. 21205

[21] Appl. No.: 164,873

[22] Filed: Mar. 8, 1988

[51] Int. Cl.[4] ..... A63F 7/06

[52] U.S. Cl. ..... 273/89; 40/621

[58] Field of Search ..... 273/89, 90; 40/621

[56] References Cited

U.S. PATENT DOCUMENTS

| | | | |
|---|---|---|---|
| 975,316 | 11/1910 | Barrett | 273/89 |
| 1,053,788 | 2/1913 | Crew | 273/89 |
| 1,157,913 | 10/1915 | Twibell | 273/89 |
| 1,526,220 | 2/1925 | Josephson | 273/89 |
| 1,642,093 | 9/1927 | Stewart | 273/89 |
| 2,975,539 | 3/1961 | Anderson | 40/621 X |
| 3,355,173 | 11/1967 | Selker | 273/89 |
| 4,179,123 | 12/1979 | Tsukuda | 273/89 |
| 4,251,074 | 2/1981 | Welker | 273/89 |

*Primary Examiner*—Anton O. Oechsle

*Attorney, Agent, or Firm*—Richard C. Litman

[57] ABSTRACT

A simulated baseball game apparatus. The game is played generally in accordance with the rules of actual baseball. The apparatus resembles an actual baseball stadium, and players hit, pitch and field using the game apparatus. Advertising can be placed on the apparatus and can be changed as desired.

5 Claims, 5 Drawing Sheets

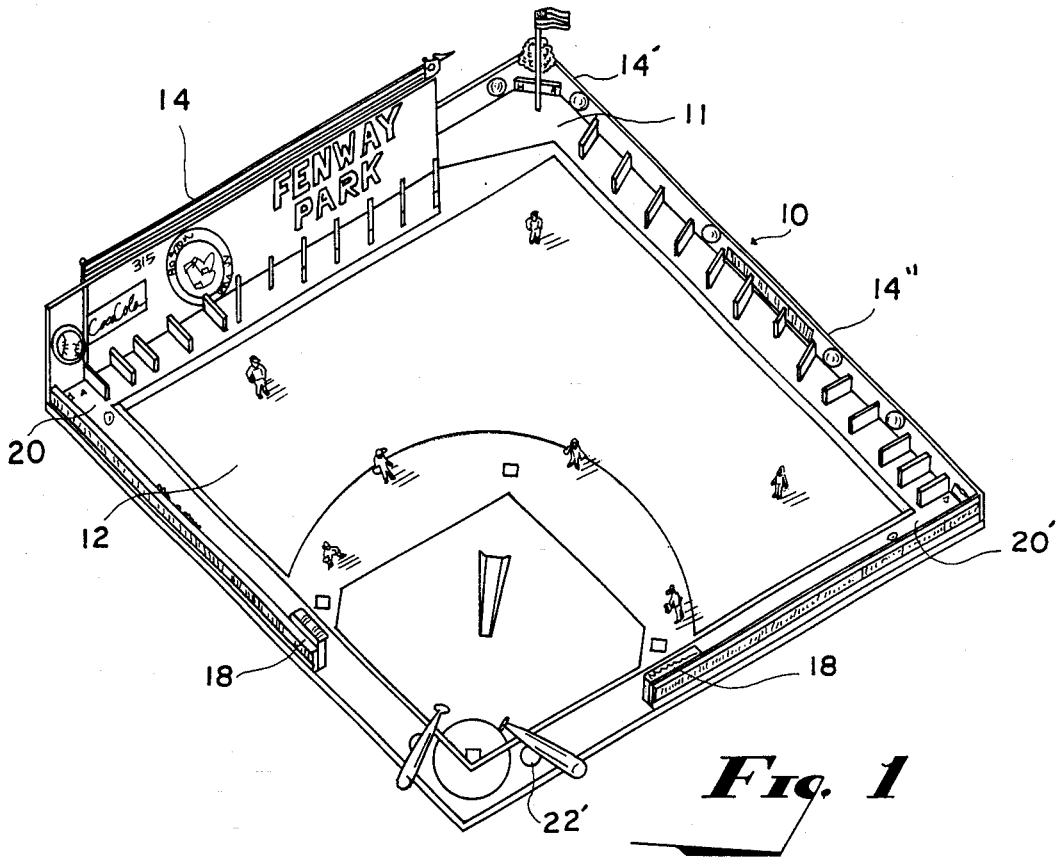
FIG. 1
FIG. 2
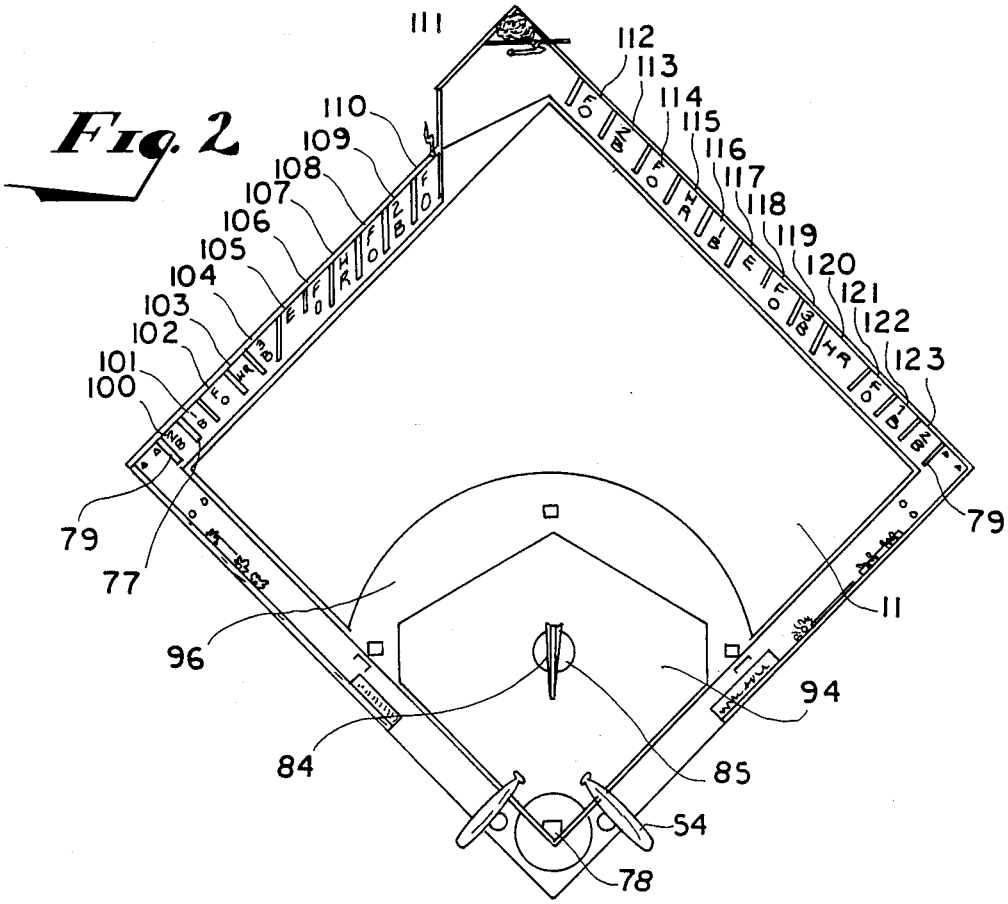

FIG. 3
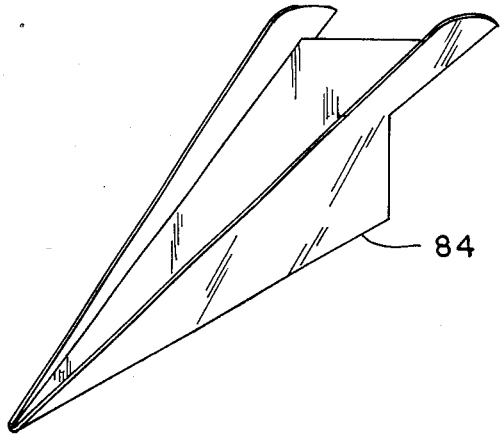
FIG. 4
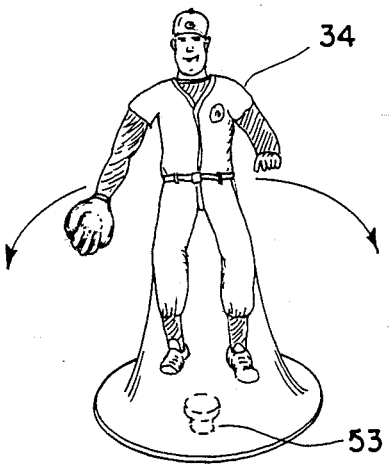
FIG. 5
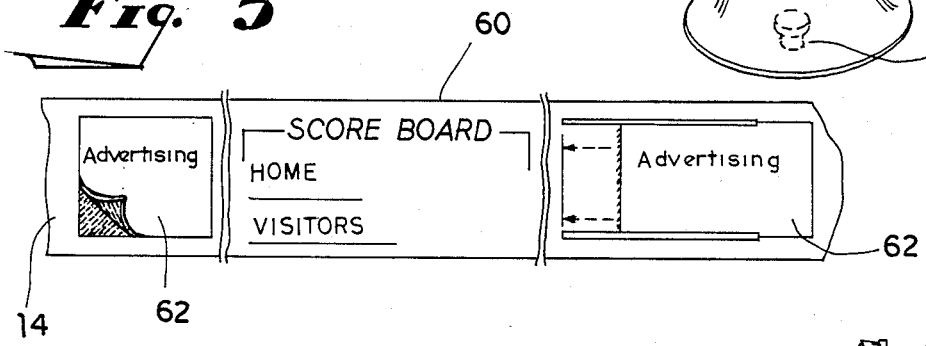
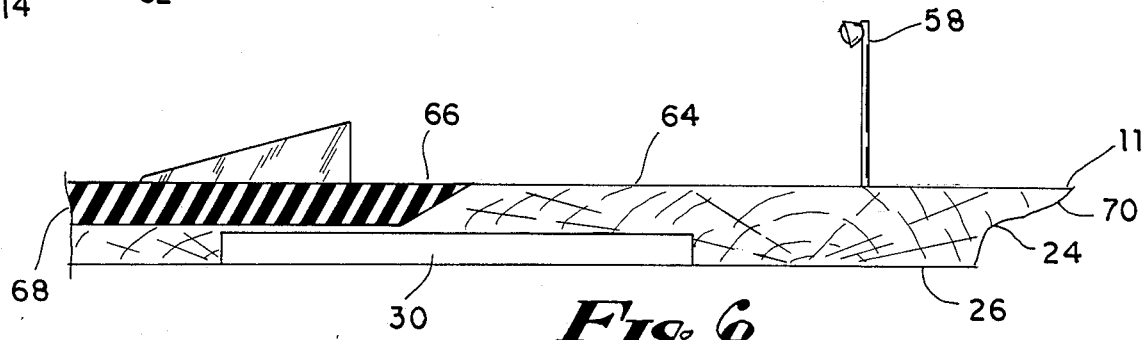
FIG. 6

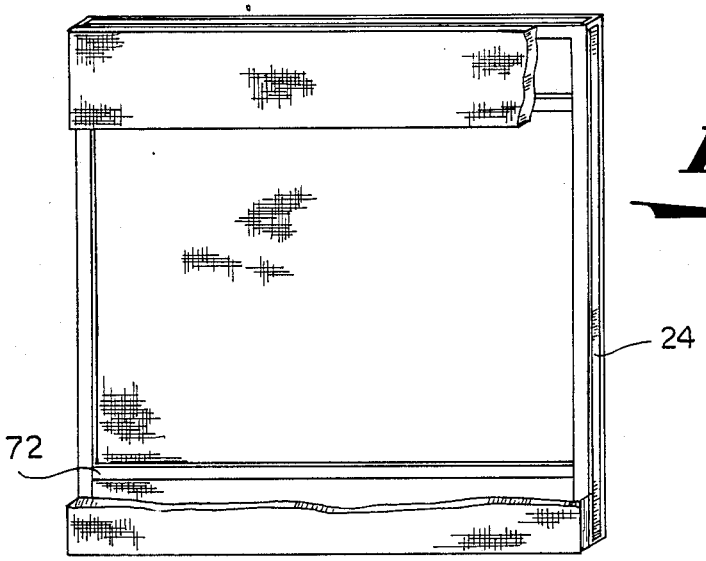
FIG. 7
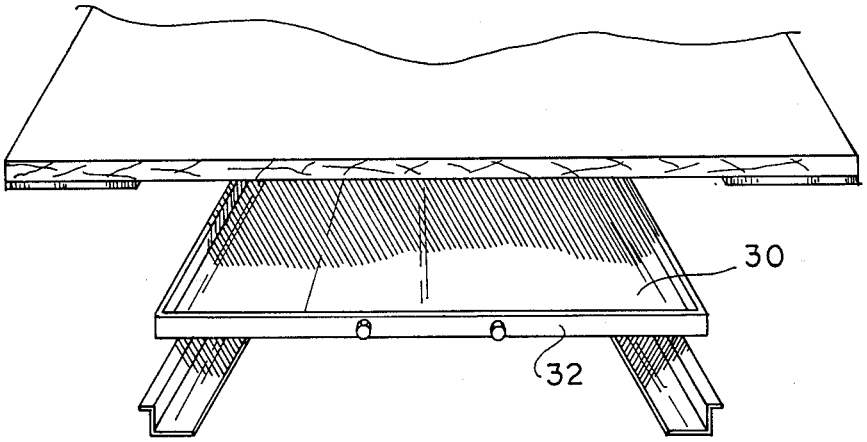
FIG. 8
FIG. 9
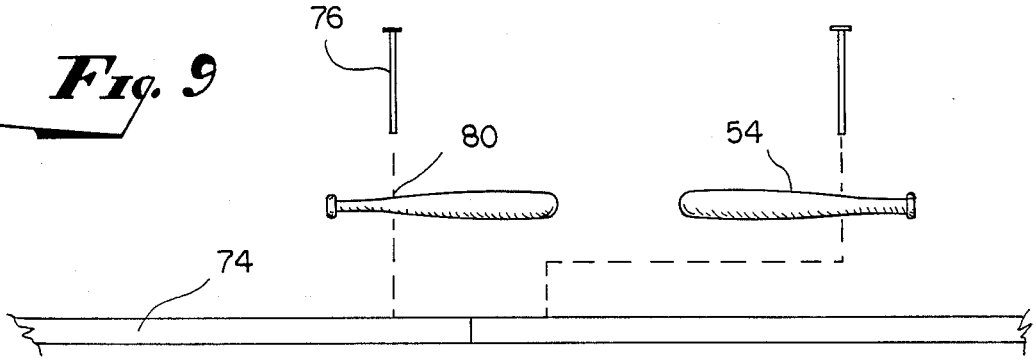

BASEBALL GAME APPARATUS

BACKGROUND AND FIELD OF INVENTION

Virtually every person who has ever picked up a ball and a bat has dreamed of playing professional baseball. The game is unique in its challenges and separates winners from losers. The thrill of a home run, and the triumph of a no-hitter are experiences only baseball can provide. To capture this spirit, the present invention simulates the actual professional game, as played for over a century, in an apparatus which provides a challenge not previously experienced by even the most veteran baseball game aficionados.

The simulated stadium can be as realistic as the players desire. In addition to a playing field, the game apparatus can include dugouts, ballpens, and all other features commonly seen in stadiums such as Memorial Stadium or Candlestick Park. A specially constructed pitching mound provides "Cy Young Award" pitching quality to the game. Fielders are provided which serve strategically to prevent hits and runs. A unique construction of the batter's box allows for realistic batting. As the batter waits for the pitch, his eyes focus on the regions at the perimeter of the field which are designated certain hit values, such as single, double or even sacrifice fly. On the walls of the stadium are advertisements and the scoreboard to track the action of the game. Whether the apparatus is used under the lights overlooking the field on a balmy night in the heat of the summer, or on Sunday afternoon in the winter, it provides excitement and challenge so real that maybe only a professional baseball player could tell the difference.

SUMMARY OF THE PRIOR ART

Various simulated baseball games have been developed since the sport was conceived in Cooperstown many years ago. Examples of such attempts include Morse's contribution, issued as U.S. Pat. No. 324,873 in 1985, Rich and Freundenweiler's game apparatus, granted U.S. Pat. No. 611,278 in 1898, and Dupeire's game as described in U.S. Pat. No. 772,344, issued in 1904, as well as numerous latter attempts. The game apparatus of each of these inventions, although including the bats and balls and other features resembling the professional game, lacked in providing the simulation of the real game. Certainly, these assemblages of baseball components provided challenges to their players, but none could simulate the team verus team competition of the pure game.

The reason for this inadequacy of prior games was that board game agility rather than baseball acumen was the key to winning the game. The present invention, with its unique apparatus, is not a mere board game. It is "real" baseball. What is required to win is more than just eye-hand coordination or physical dexterity. Winning requires baseball savvy, coordinated game plans, and the zealous desire to beat an opponent.

None of the simulated baseball games developed to date, either singly or in combination, disclose an apparatus so constructed as to truly test baseball talent. Features of the present invention accomplish this objective in a manner not previously known.

SUMMARY OF THE INVENTION

An object, advantage and feature of the invention is to provide a realistic, simulated baseball game apparatus.

A further object, advantage and feature of the invention is to provide means to display advertising on the apparatus, which can be removed or changed as desired.

A further object, advantage and feature of the invention is to provide means for pitching a simulated baseball in a manner similar to professional pitches.

A further object, advantage and feature of the invention is to provide a unique construction of a batter's box to enable the skilled batter to maximize his talents.

A still further object, advantage and feature of the invention is to provide a challenging game of simulated baseball using the apparatus of the invention. A further object, advantage and feature of the invention is to provide a baseball playing field construction that has features which test hitting skill and offensive strategy, as well as the fielding skill of each of the nine players on the opponent's team, and the defensive game plan of the opponent.

These and other objects of the invention are apparent from the following description of the novel construction of the game apparatus disclosed herein.

BRIEF DESCRIPTION OF THE DRAWINGS

FIG. 1 is a perspective view of the simulated game playing apparatus of the invention, showing an example of the stadium construction and fielders thereon.

FIG. 2 is a top plan view of the playing surface, further illustrating at the perimeter thereof values associated with various offensive measures seen in the real game.

FIG. 3 shows a perspective view of one embodiment of the pitching apparatus of the invention.

FIG. 4 shows a perspective view of a representative fielder.

FIG. 5 is a front view of a section of the wall of the stadium, showing the score board, and examples of types of construction which permit the changing of advertising messages as desired.

FIG. 6 is a sectional view through one embodiment of the stadium, wherein the playing surface has differing textures and has lights positioned thereon.

FIG. 7 is a plan view of the underside of the playing surface of the stadium shown in FIG. 6, showing construction permitting the players to change the material providing the foundation of the playing field.

FIG. 8 is an exploded view of a version of the stadium wherein the apparatus has a cavity therein for storage of components.

FIG. 9 is an exploded view of an alternate embodiment of the batting assembly of the invention.

Figure 10:
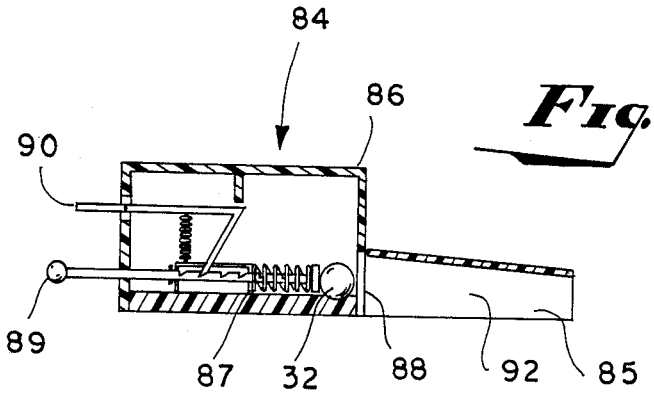
FIG. 10 is a sectional view of an alternate embodiment of the pitching apparatus of the invention.

FIG. **10*a* is a top plan view of the pitching apparatus shown in FIG. 10**.

Figure 11:
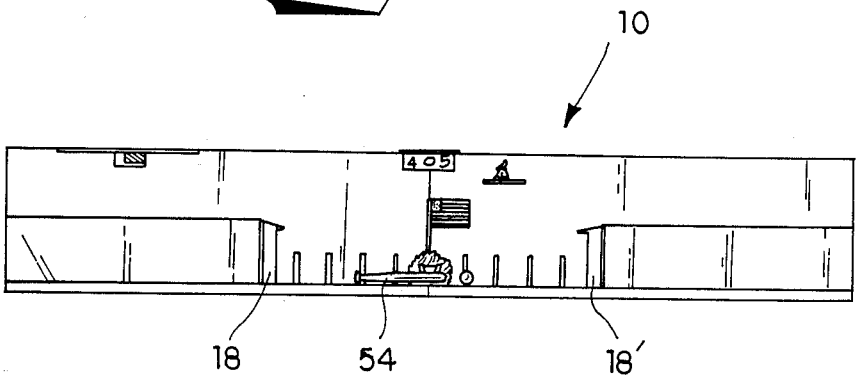

FIG. 11 is an elevational view of an alternate embodiment of the simulated game playing apparatus of the invention.

Figure 12:
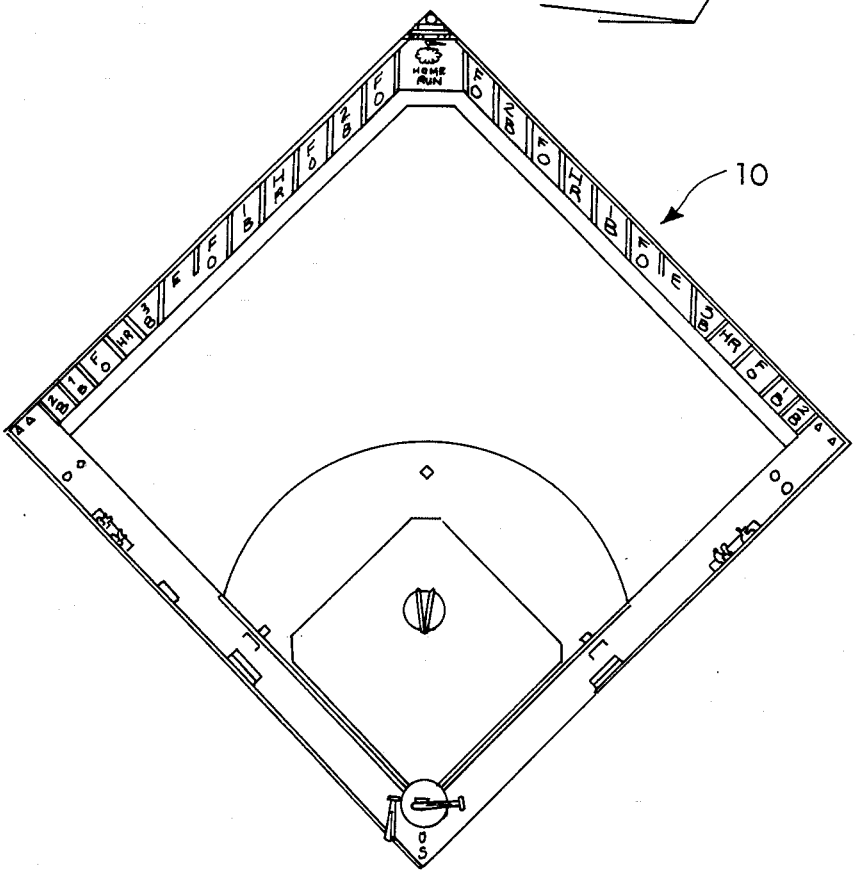

FIG. 12 is a top plan view of the simulated game playing apparatus shown in FIG. 11.

DESCRIPTION OF THE PREFERRED EMBODIMENT

Referring now to the drawing where like numerals refer to like parts throughout, the simulated game playing apparatus or stadium 10 includes a playing surface 11 having a playing field 12, walls 14, 14', and 14'', representing the left field fence 14, center field fence 14', and right field fence 14'', respectively. Simulated stadium seating 16 (not shown in drawing), as well as dugouts 18 and 18', ballpens 20 and 20', on deck circles 22 and 22', and other simulated components of various sorts, as found in actual professional baseball stadiums, can be provided. Playing surface 11 is supported on base 24.

The bottom 26 of base 24 is generally flat so that it can be placed in a level position on a floor, table, cement or grass. Hook members to secure the base 24 to carpet, or similar affixing means such as suction cups or felt, can be used. Base 24 can have a storage compartment 30 therein, accessible through drawer 32 located on a side of the apparatus or from the top if playing surface 11 is detachable from base 24. Compartment 30 can be used to store the equipment used to play simulated baseball, such as simulated baseball 32 (which can have threads thereon), player indicia 34 representative of the various ball players, bats 54, etc. The base 24 can have a handle or a storage hook, or the stadium 10 can be constructed to fit into a carrying case.

Base 24 can be positioned on a rotating flexible turntable, having 4 notches therein spaced equally apart at the perimeter of the turntable. Corresponding members on base 24 can be employed to secure the base to the turntable so that the playing surface can be oriented in one of four possible desired positions. A locking lever affixed to the notches 29 can be used to release or engage said base from the turntable.

The base 24 can have in compartment 30 a receptacle 56 for securing batteries (not shown) which through conventional wiring 57 (not shown) to the walls 14, 14', and 14'' can activate lights 58 for night play, advertising displays 62, or scoreboard 60. Alternatively, a conventional flip type scoreboard or score sheets used in the actual game can be employed. The advertising means can be so constructed so that the manufacturer or player can insert and remove the message desired. Either a magnetic backing can be used on the advertising, with a corresponding metallic base on wall 14 or a transparent sleeve of plastic material can be used, both shown in FIG. 5. Advertising printed on material with an adhesive backing can also be secured to wall 14. The batteries 58 can also be used to activate a special ball/strike sensor system 62 which could be an optional feature of the invention (as discussed below).

The playing surface 11 can be constructed of wood, metal or lightweight synthetic materials. It can be rigid and generally flat, or means could be provided for varying the height and/or texture of the surface. Playing surface 11 optionally could have a top surface 64 of synthetic grass, and layers of various substances underneath surface 11. Under infield region 66 a soft, spongy material 68 can form the foundation for the infield and a harder material 70 can be the foundation for the outfield region 72. The firmness of the materials 68 and 70 can be adjusted as desired by substituting materials of differing thicknesses or hardness under surface 64; this can be accomplished by materials 68 and 70 being detachably mounted into frames 72 under surface 64 and accessible by detaching surface 11 from base 24 or through base 24 if the opening therein is on the side.

On surface 11 is a batting box 74 having means for detachably mounting rotatable bats 54 of various sizes thereon, by providing a frictional engagement of a securing pin 76 positioned on the left or right side of home plate 78, or both, which is engageable with a corresponding bore 80 on bat 54. The batter can use the bat 54 of choice, or switch to other bats as desired. Alternatively, bats 54 and 54' can be permanently affixed to surface 11, on the left and right side of home plate 78, respectively.

In one version of the game, balls and strikes are not correlated with whether a pitch crosses home plate; however, in an alternate version, a ball/strike sensor system can be employed. As ball 32 crosses the plate, a pressure actuated switch 82 (not shown) under home plate 78 causes a buzzer 84 (not shown) to sound. As previously described, batteries 58 can empower system. System can also be wired to scoreboard 60 so that ball/-strike statistics can be displayed.

Pitching apparatus 84 located on the pitching mound 85 is elevated at approximately a 20° angle with respect to surface 11. It can be constructed of clay, packed dirt or synthetic material, and can be constructed as shown in FIG. 3 wherein channel 92 is employed; the pitcher places the ball at the top thereof and gravity causes the ball to roll down a narrowing channel towards home plate.

Figure 10A:
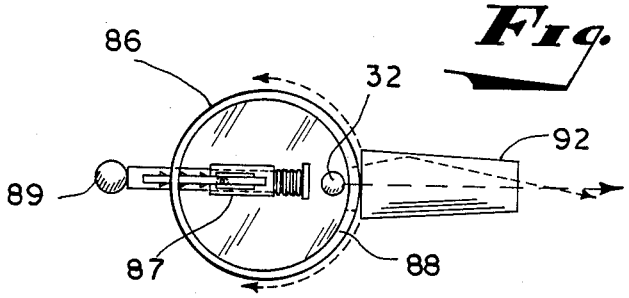

The base of channel 92 can have a forked construction, thereby providing 3 different narrow channels. The channel 92 can have curved walls to facilitate the rolling of the ball. Alternatively, mound 85 can have pitching system 86 which provides means for pitching ball 32 as desired, e.g., fast ball, slider, curve ball, etc. System 86 includes a wind up assembly 87 including a spring loaded pitch release 89 whereby ball 32 is placed in hole 88 which retains the ball. As the pitcher sets lever 90 to a desired position, tension on release 89 increases or decreases. The greater the tension of release 89, the faster the pitch will be. Pulling rearward on release 89 causes ball 32 to roll down channel 92 toward home plate 78. Channel 92 can be positioned at varying angles with respect to wind up assembly 87 (as shown in FIG. 10*a*). Pivotable mounting of pitching system 86, enables the pitcher to adjust the curve or angle at which ball 32 crosses home plate 78. In a modification of this alternate version of pitching system 86, wind up assembly 87 can be of a fixed tensions(s) and channel 92 is set in a designated position with respect thereto.

When a pitch is hit by a batter, the ball 32 travels on playing surface 11. The location where it stops determines the value accorded the batter. If it stops within area 94 of infield region 66, which is inside base path 96 it is an infield single. If it stops outside this area, and not in a slotted region 100–123, it is an out. Slotted regions are located at the perimeter of playing surface 11. Each region is defined by two partitions 77, each partition has an angle with respect to home plate 78 which varies depending upon the difficulty of the hit obtained by the ball 32 stopping in the particular slotted region. For example, the angles of the partitions 77 defining slotted regions for triples (3B) provides for a smaller opening, and hence greater difficulty, for a batter to obtain such a hit, as contrasted with the openings of the slotted regions for singles, (1B), doubles (2B), etc. Furthermore, the number of slotted regions for each type of hit may vary depending upon the difficulty factor desired.

In the preferred embodiment, shown in FIG. 2, slotted regions 101, 116, and 122 have designated values as singles. Slotted regions 100, 109, 113, and 123 have designated valves as doubles. Regions 104 and 119 are designated as triples. Regions 103, 107, 111, 115 and 120 are designated as home runs. Regions 105 and 117 are designated values as "errors", thus enabling the batter to advance to first base.

Each of these regions, as previously stated, is defined by partitions 77, which are positioned at differing angles with respect to the perimeter of the stadium. For example, partitions 77 of slotted regions 100, 101, 102, 103, 121, 122, and 123, are at generally 90 degree angles to the perimeter; slotted regions 105–110, and 112–119, are generally at angles within the range of 30–50 degrees with respect to the perimeter (optimally at about a 32 degree angle); regions 104, 111 and 120 are defined by two partitions 77, each being at a different angle with respect to the perimeter (one partition being at a generally 90 degrees angle and the other at a generally 32 degrees angle). Certain slotted regions (102, 106, 108, 110, 112, 114, 118, and 121) may be designated for "fly outs," (FO). Selected ones of these may further have indicia thereon representing sacrifice flies (e.g., regions 110 and 112).

Defensively, the fielding team, either player indicia 34–43 or 44–52, depending upon which team is in the field, can provide further difficulty for a batter to obtain an extra base hit, or, depending on skill, any hit.

The fielders are either permanently affixed by glue or similar means at designated positions on playing surface 11, as shown in FIG. 1, making it more difficult to obtain certain hits, or can be detachably affixed at positions determined by the player. In this embodiment, magnetic means, non-permanent chemical adhesives, or a hook and loop fastener arrangement, or pegs 53 on the base of the fielders, can be employed, and depending upon the means utilized, playing surface 11 can have a corresponding construction.

The fielders can be fabricated of resilient material enabling a player to bend or move in varying directions one or more of said fielders (as shown in FIG. 4). Optionally, the fielder may have a glove with magnetic means so that a player can position it such that a simulated baseball 32, constructed of a metallic substance, can adhere to the glove. If this occurs, the hit will be valued as an out.

Similarly, the batting team's player indicia, or other indicia, can be employed to track the batter's hits, such as moving said indicia on the base path in accordance with the hits obtained. Said indicia can be constructed in the same manner as the fielder's, thus they can be resilient and can be employed offensively to deflect a batter's hit so that a desired valuation thereof can be obtained.

The game apparatus described above is utilized to play a simulated game of baseball. The basic rules of the actual game are followed, with a few modifications.

When two people play, the game begins with one player pitching and the other batting. The pitcher sits opposite the batter. In one embodiment, the pitcher would utilize the pitching apparatus 84, shown in FIG. 3, and would place the ball at the top of the ramp (apparatus 84) and let the ball roll freely down the ramp toward home plate 78. The batter can bat from the left or right side of home plate. The batter tries to hit the ball into the slotted regions 100–123. It is suggested that the batter engage in batting practice, and, when batting, use bat control and not hit the ball with excessive force. In the game, .300+ hitters are few, just as in the actual game.

If a ball hits any fielder, it is deemed an out. However, a ball which hits the pitching mound 85 then continues through the infield (e.g., between the shortstop and second baseman) is still in play. A ball which stops in the infield region 66 is considered an infield single. A ball which hits partition 77 and doesn't go into a slotted region is an out. A ball which hits a partition 77 must go into a slotted region in order for the designated value of the slotted region to be applicable. A ball which hits partitions 79, demarcating the foul lines (in the preferred embodiment, color coded "yellow"), is a home run unless it had hit a fielder while enroute. A ball which stops in outfield region 72 is an out. A sacrifice fly is possible; a ball which stops in the "fly out" slotted regions 110 and 112, which is color coded with orange dots in the preferred embodiment, would be designated a sacrifice fly. A ball which stops on the portion of the outfield immediate to the slotted regions (commonly known as the "warning track") is an out. A ball hit too slowly and radically changes direction would be an out. Three foul balls would also be an out. p Double plays are possible when the ball hits an infielder, including the pitcher. A runner on third base cannot score on a double play. A double play with the bases loaded would be outs at home plate and first base.

As is apparent, these and other variations of the game apparatus are considered within the spirit of this invention and can be utilized in playing a simulated baseball game in accordance with the rules of professional baseball. The description included herein is not intended to limit the scope of the invention as defined in the accompanying claims.

We claim:

1. An apparatus resembling an actual baseball stadium having a playing surface, home plate and baseball field indicia, for playing a simulated baseball game comprising;

a simulated baseball;

hitting means including simulated bats rotatably affixed to both the left and right side of home plate;

pitching means for initiating and directing a pitch toward home plate;

fielding means including resilient indicia representing fielders affixed at designated areas on the playing surface;

hit valuation means;

means thereon for advertising products or services, said means including means to change the message as desired; whereby a simulated game of baseball is played thereon.

2. An apparatus as described in claim 1 wherein said simulated bats are detachable.

3. An apparatus as described in claim 1 wherein said fielders affixed at designated areas are detachable.

4. An apparatus as described in claim 1 wherein said hit valuation means includes regions on said playing surface designating selected hit results.

5. An apparatus as described in claim 1 wherein;

said simulated bats are detachable;

said fielders affixed at designated areas are detachable; and said hit valuation means includes regions on said playing surface designating selected hit results.

* * * * *